US007229206B2

(12) United States Patent
Whitney

(10) Patent No.: US 7,229,206 B2
(45) Date of Patent: Jun. 12, 2007

(54) GEOMETRIC AND PERFORATED PAINT MIXER AND PAINT ROLLER CLEANER

(76) Inventor: Mike Whitney, 2581 County Rd. 306, Elk Creek, CA (US) 95939

( * ) Notice: Subject to any disclaimer, the term of this patent is extended or adjusted under 35 U.S.C. 154(b) by 295 days.

(21) Appl. No.: 10/923,677

(22) Filed: Aug. 24, 2004

(65) Prior Publication Data

US 2005/0018533 A1 Jan. 27, 2005

Related U.S. Application Data

(63) Continuation-in-part of application No. 10/283,131, filed on Oct. 30, 2002, now abandoned, which is a continuation-in-part of application No. 09/621,079, filed on Jul. 21, 2000, now Pat. No. 6,520,672, which is a continuation-in-part of application No. 09/273,473, filed on Mar. 22, 1999, now abandoned.

(51) Int. Cl.
*B01F 7/18* (2006.01)

(52) U.S. Cl. ..... 366/129; 366/308; 366/326.1; 366/343; 366/605; 134/149; 134/900

(58) Field of Classification Search ..... 366/129, 366/285, 308, 326.1, 343, 605; 134/149, 134/900

See application file for complete search history.

(56) References Cited

U.S. PATENT DOCUMENTS 385,151 A 6/1888 Thompson
820,405 A * 5/1906 Dunlap ..... 366/343
1,841,435 A 1/1932 Gibson
2,799,485 A 7/1957 Silverman
2,896,925 A 7/1959 Place
2,931,661 A 4/1960 Harris
3,460,268 A 8/1969 Greathouse
3,925,908 A 12/1975 Dunn
4,054,272 A 10/1977 Cooke
4,545,395 A 10/1985 Kolb
5,073,033 A * 12/1991 Klepeis ..... 366/343
5,183,336 A * 2/1993 Poltorak et al. ..... 366/273
5,984,518 A 11/1999 King et al.
6,012,473 A 1/2000 Koyama

* cited by examiner

*Primary Examiner*—David Sorkin
(74) *Attorney, Agent, or Firm*—Cantor Colburn LLP; Randy Shay

(57) ABSTRACT

The present invention sets forth an implement which enables the user to mix paint, clean the can and can lip, and to clean conventional paint rollers utilizing a hand drill. The implement is selectively adjustable to be configured to mix paint in large and small containers and to support a paint roller for cleaning, thereby being capable of providing several functions. The implement is provided with a paddle member that is perforated and of a geometric form to enhance mixing. A paint can remover and a paint can rim cleaning device are also incorporated into the implement. A single implement serves the six functions of opening paint cans, stirring paint in large or small containers, cleaning the groove around the lip of a paint can, cleaning a paint roller, and as a spatula to aid in removing paint from a can.

18 Claims, 11 Drawing Sheets

GEOMETRIC AND PERFORATED PAINT MIXER AND PAINT ROLLER CLEANER

REFERENCE TO RELATED APPLICATION

This is a continuation-in-part of application Ser. No. 10/283,131, filed 30 Oct. 2002, now abandoned, which is a continuation-in-part of application Ser. No. 09/621,079, filed 21 Jul. 2000, now U.S. Pat. No. 6,520,672, which is a continuation-in-part of application Ser. No. 09/273,473, filed 22 Mar. 1999, now abandoned.

BACKGROUND OF THE INVENTION

1. Field of the Invention

The present invention relates to painting accessories, and more particularly to a painting implement that assists in diverse operations of hand painting, such as opening the can, mixing and stirring paint solutions, as well as aiding in cleaning the used paint roller, can and can lip.

2. Description of the Prior Art

Painting by hand, particularly building walls and partitions and other large objects, requires different tools such as brushes and rollers for applying paint to surfaces being painted. When a painter interrupts his or her work for any reason, it is a wise precaution to clean brushes and rollers so that paint will not dry and cake thereon. Frequently this is done by wiping brushes and even rollers on a convenient surface, such as the inner flange of a paint can. However, wiping leaves a considerable amount of paint on the brush or roller.

The prior art has taken note of the problem of efficient cleaning paint supplies, and has proposed apparatus to expedite cleaning. The prior art as seen in U.S. Pat. No. 3,925,908 (issued to Kirkley J. Dunn on Dec. 16, 1975); U.S. Pat. No. 6,012,473 (issued to Takehiko Koyama on Jan. 11, 2000); U.S. Pat. No. 3,460,268 (issued to Carl F. Greathouse on Aug. 12, 1969); U.S. Pat. No. 4,545,395 (issued to Kolb on Oct. 8, 1985); U.S. Pat. No. 5,984,518 (issued to King et al. on Nov. 16, 1999); and U.S. Pat. No. 2,931,661, (issued to Joseph N. Harris on Apr. 5, 1960) as cited in the previous parent application Ser. Nos. 09/621,079 and 10/283,131 are all incorporated herein as reference.

The prior art is replete with devices designed to address the problems of adequate paint mixing as shown in the references to Cooke (U.S. Pat. No. 4,054,272), Silverman (U.S. Pat. No. 2,799,485), Gibson (U.S. Pat. No. 1,841,435); and Place (U.S. Pat. No. 2,896,925). These disclosed patents provide novel means of mixing paint solutions however none of these devices may also be used during the painting process serving as a paint solution mixer in addition to a paint roller cleaner.

Additionally, U.S. Pat. No. 385,151, issued to George M. Thompson on Jun. 26, 1888, discloses an AGITATOR FOR CASKS OR BARRELS in which a paddle member is rotatably mounted to a shaft for agitating within a barrel after insertion through the bung hole of the barrel. Unlike Thompson, the stop means of the present invention allows the paddle member to travel only through a predetermined arc, preventing the paddle member from becoming fully parallel to the shaft.

None of the above inventions and patents, taken either singly or in combination, is seen to describe the instant invention as claimed.

SUMMARY OF THE INVENTION

The present invention sets forth a painting implement which enables the user to open paint cans, mix paint and to clean conventional paint rollers utilizing a hand drill, as well as cleaning the can lip of accumulated paint. The painting implement is selectively adjustable to be configured to mix paint and to support a paint roller for cleaning, thereby being capable of providing several functions. Implements of different diameters may be provided, for cleaning and using an assortment of sizes of paint rollers. The implement is provided with a paddle member that is perforated and of a geometric non-planar form to enhance mixing, as well as a paint can opener tab and a can lip cleaning tab.

It is therefore an object of the invention to provide an implement for painting that performs several painting related functions including can opening, paint mixing, roller cleaning, can lip cleaning.

It is another object of the invention that the implement engage a hand drill for imparting rotation for paint mixing, and cleaning of paint rollers.

It is a further object of the invention that the implement engage paint rollers of different dimensions, thereby cooperating with standard painting tools.

It is an object of the invention to provide a painting implement for the purposes described which is inexpensive, dependable and fully effective in accomplishing its intended purposes.

It is a further object of the invention to provide a painting implement that assumes two different functional positions with ease.

It is an object of the invention to provide a painting implement that is effective but simple in design resulting in lower manufacturing costs.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1A:
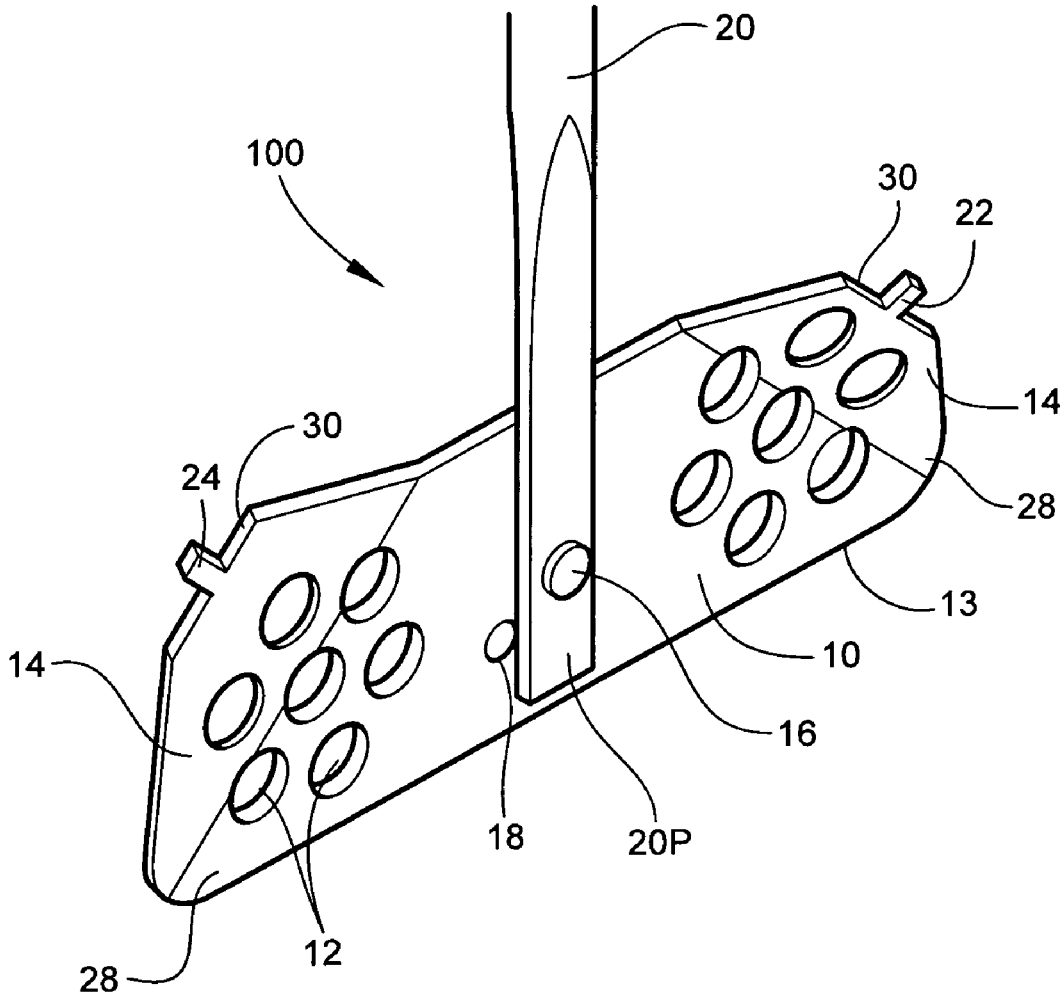
FIG. 1A is a front view of the inventive painting implement in a first position.
Figure 1B:
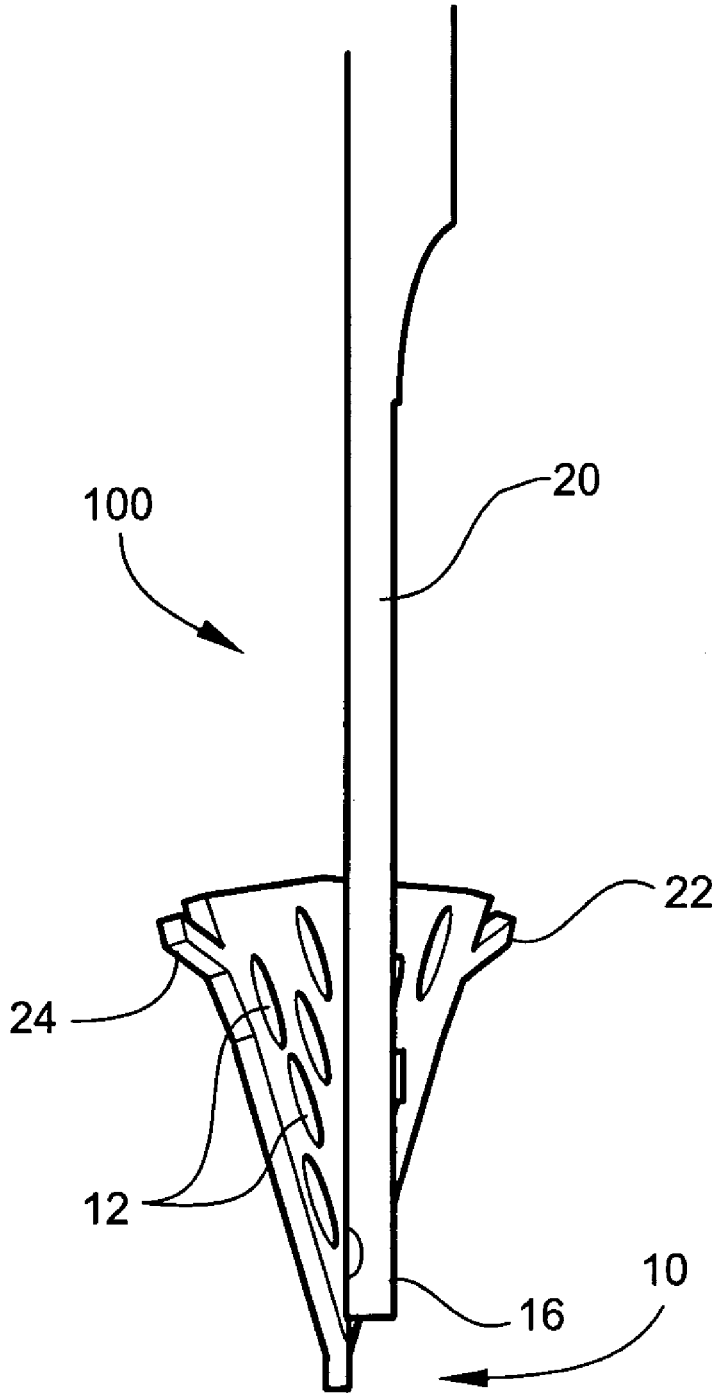
FIG. 1B is a side view of the inventive painting implement in a first position.

FIGS. 1A and 1B show the inventive, geometrically shaped painting implement 100. As can be seen, the inventive painting implement 100 has a paddle member 10, having a length, height and thickness, and ideally having slightly rounded lower corners 28 adapted to lessen the severity of any impacts between the corners of the paddle member and a container in which it is being used. The lower edge 13 of the paddle member 10 may be variously shaped to form a spatula to aid in the removal of paint from a paint can. The paddle member 10 is attached to a proximal end 20*p* of a rod shaft 20, preferably at the center of the paddle member 10, by a pivoting fastener 16. The rod shaft 20 is typically cylindrical, transitioning to flattened, opposing faces at the proximal end 20*p*, thereby providing a flat interface between the rod shaft 20 and the face of the paddle member 10. The fastener 16 may comprise any suitable means of connection, such as a rivet, bolt and nut, etc., which provides selective rotational movement of the paddle member 10 relative to the axis of the rod shaft 20 allowing the paddle member 10 to move between two positions, discussed further below.

A plurality of perforations 12 are formed through the paddle member 10, thereby allowing a viscous fluid (hereinafter referred to as paint, although it would be evident to one of ordinary skill in the art that the implement 100 could be used for stirring other viscous fluids, such as sheetrock mud or spackling) being stirred to pass therethrough, increasing the agitation rate of the paint. The apertures 12 may be formed at differing angles from one another as they pass through the thickness of the paddle member 10, further aiding in more thorough mixing.

Additionally, a portion of each end of the paddle member 10 is deflected from the plane in which the rest of the paddle member 10 lies. The line of each of the two deflections 14 typically extends from a lower corner 28 of paddle element 10 to a point between the corresponding upper corner 30 and a midpoint between the two upper corners 30. The two deflections 14 extend, respectively, to opposite sides of the plane of the paddle member 10 from one another, such that as the paddle member 10 rotates around the rod shaft 20 in a clockwise rotation, each of the two deflections 14 precedes the plane of the paddle member 10, thereby aiding in cutting into the paint as the paddle member 10 rotates, creating a wave action in the paint as it is stirred. It would be evident to one of ordinary skill in the art that the exact shape of the deflections 14 could vary or that paddle member 10 could be formed without the deflections 14 without departing significantly from the spirit of the present invention.

A stop nub 18 extends outwardly from the surface of paddle member 10 to one side of shaft rod 20, at a point proximate the proximal end 20*p* of shaft rod 20, below the pivoting fastener 16. The stop nub 18 limits the rotation of the paddle member 10 about the pivoting fastener 16 to an arc, typically less than 90°, by engaging the shaft rod 20 such that paddle member 10 may rotate between a position that is substantially normal to shaft rod 20 or substantially parallel to shaft rod 20, although preferably at a slight angle from truly parallel, as will be further detailed below. Stop nub 18 has rounded shoulders which allows a user to vary the tightness of the connection between the stop nub 18 and the rod shaft 20 by twisting the paddle to varying degrees, thereby affecting whether or not, and how much, stop nub 18 passes under the rod shaft.

In the preferred embodiment, the upper corners 30 of the paddle member 10 are cut on a diagonal, as opposed to the rounded lower corners 28. Extending from a first of the diagonal upper corners is a substantially rectilinear paint can opener 22 protrusion dimensioned and configured to fit under the rim of a paint can lid (not shown) to pry it open. The can opener protrusion 22 extends at a slight angle from the plane of the deflection 14. Extending from the second of the diagonal upper corners is a second substantially rectilinear lip cleaner 24 protrusion dimensioned and configured to fit within the rim lip (not shown) of a paint can to aid in the removal of paint accumulated in the rim lip (not shown).

Figure 3:
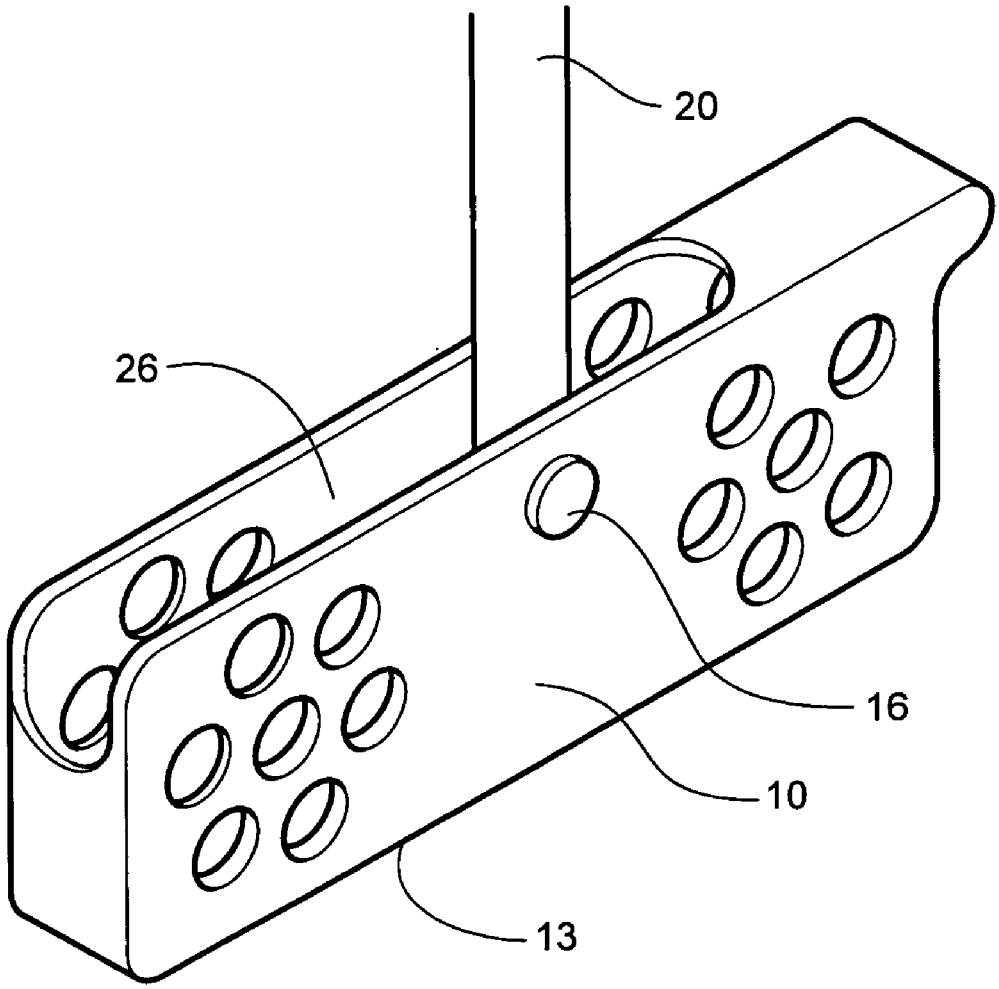
FIG. 3 is an environmental perspective view of a second embodiment of the painting implement of the present invention having a shaft receiving groove formed therein.

In an alternative embodiment, rather than shaft rod 20 being attached to the paddle member 10 on one side of paddle member 10, paddle member 10 can be formed with a groove 26 along the upper edge thereof (FIG. 3), the end of rod shaft 20 being rotatably affixed therein by a pivot fastener 16 such that as the paddle member 10 is rotated about the pivot fastener 16 to the substantially parallel position, the rod shaft 20 fits into the groove 22, the walls of the groove 26 acting in lieu of the stop nub 18.

Figure 4A:
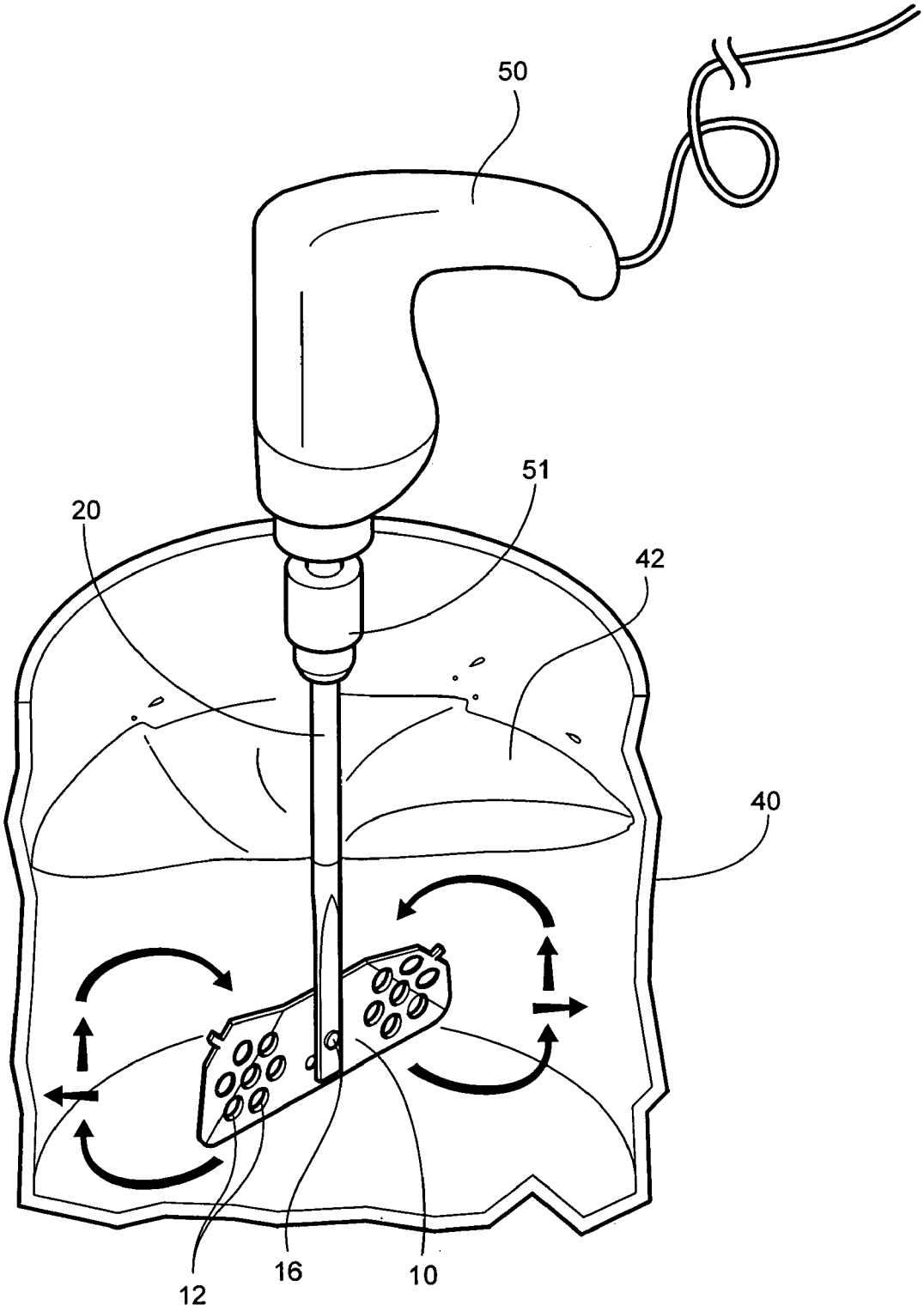
FIG. 4A is an environmental perspective view of the painting implement of the present invention stirring paint in a wide container.
Figure 4B:
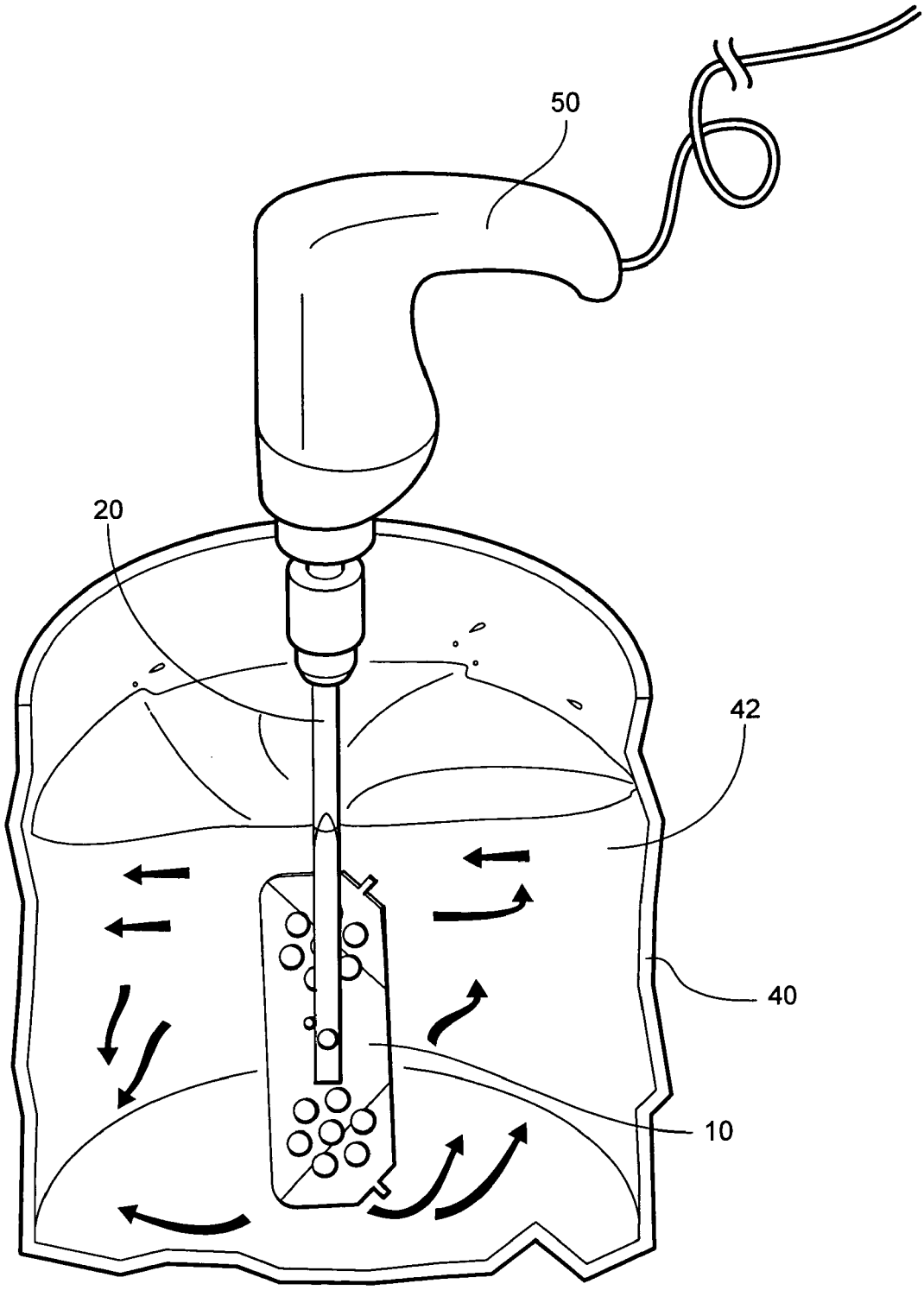
FIG. 4B is an environmental perspective view of the painting implement of the present invention stirring paint in a narrow container.
Figure 6:
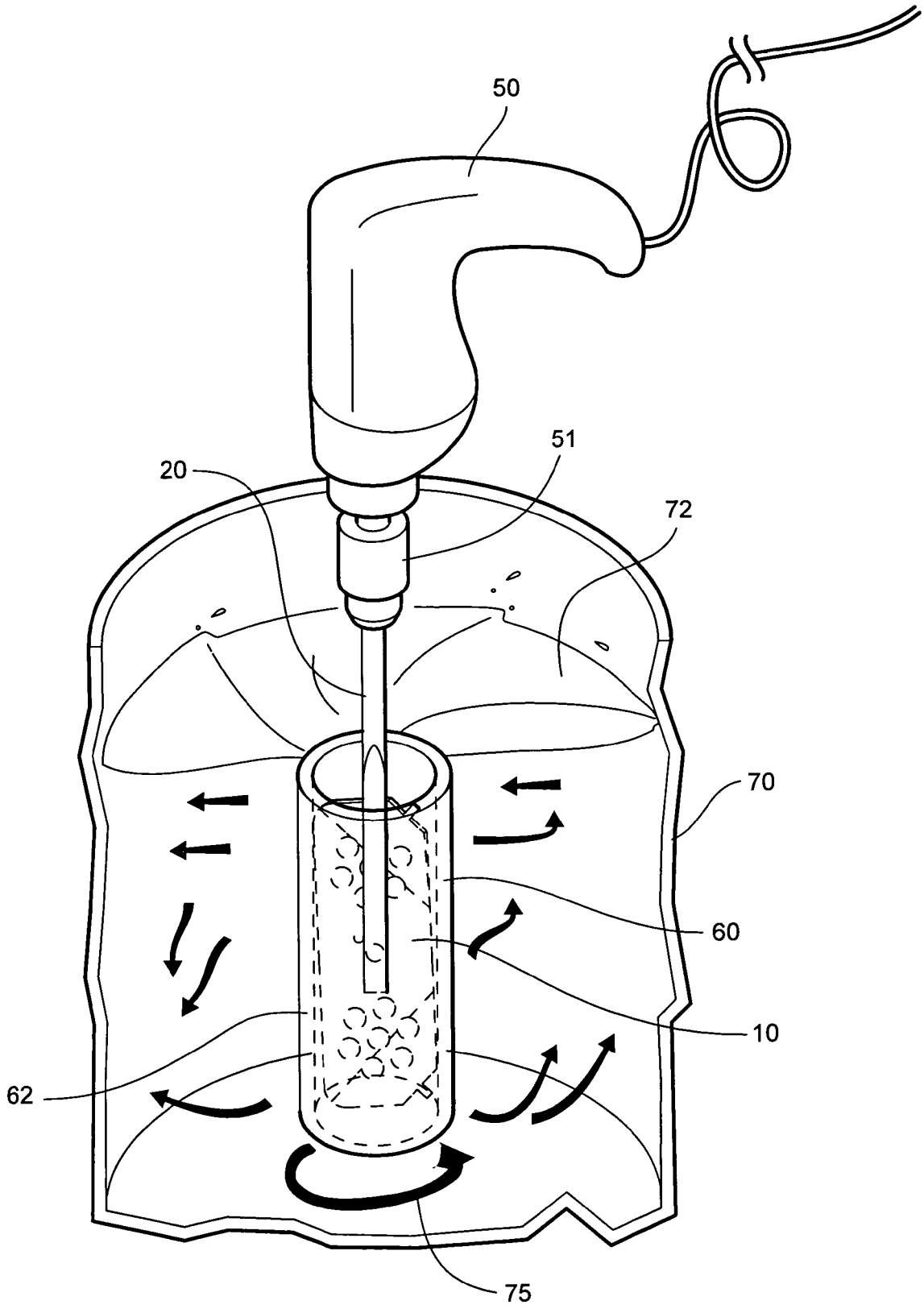
FIG. 6 is an environmental perspective view of the painting implement in use cleaning a paint roller in a wide container filled with solvent.

As stated, the inventive painting implement 100 may be set at two functionally distinct positions depending on the operation being performed with paddle member 10. FIGS. 1A and 1B illustrate the first, lateral or normal position, which is employed when the implement 100 is used as a mixer/stirrer in larger paint containers (typically 1 gallon and larger). As shown in FIGS. 4A, 4B and 6, the rod shaft 20 is an elongated, rigid shaft for coupling the paddle member 10 to an electrically operated hand drill 50. It would be evident to one of ordinary skill in the art that the shaft 20 could be grasped in the hand and the implement used as a hand-held stirring device without departing from the spirit of the present invention.

Figure 2A:
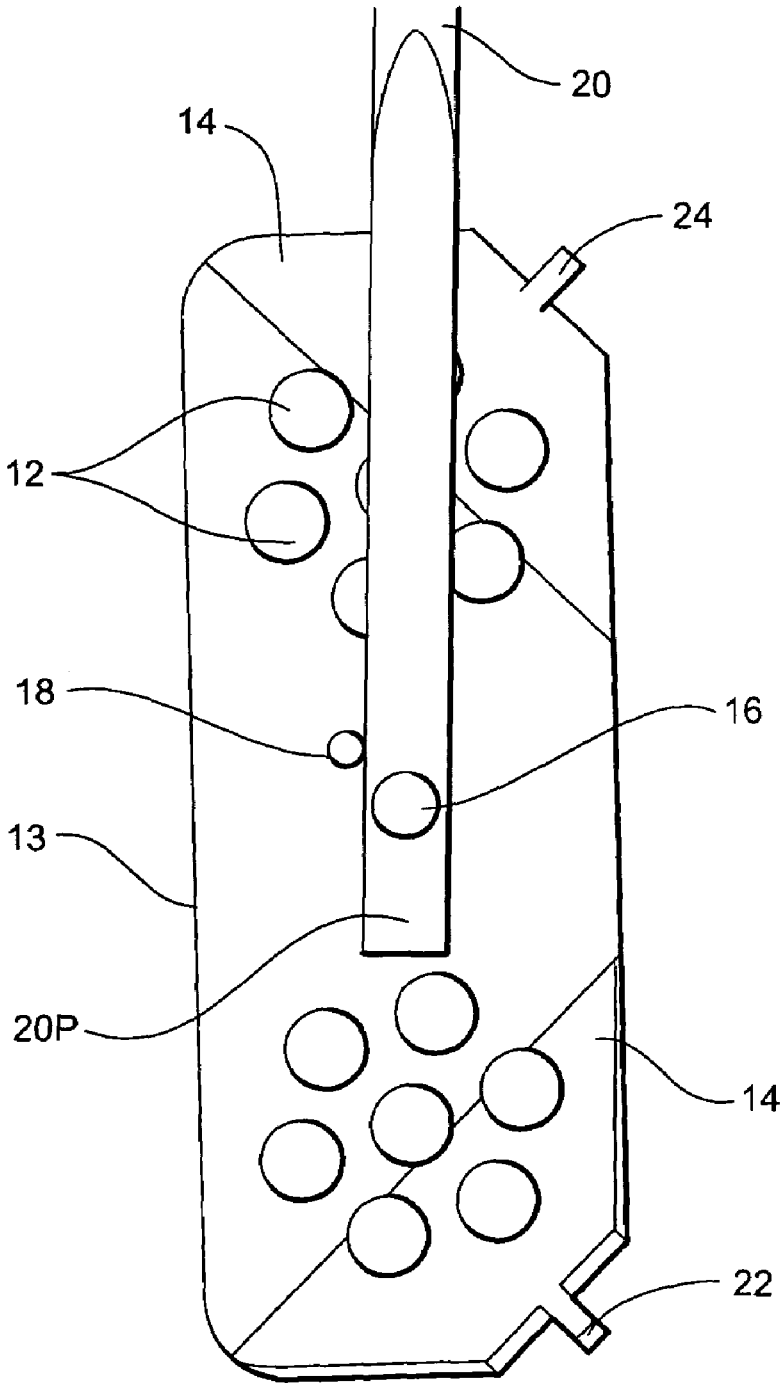
FIG. 2A is a front view of the inventive painting implement in a second position.
Figure 2B:
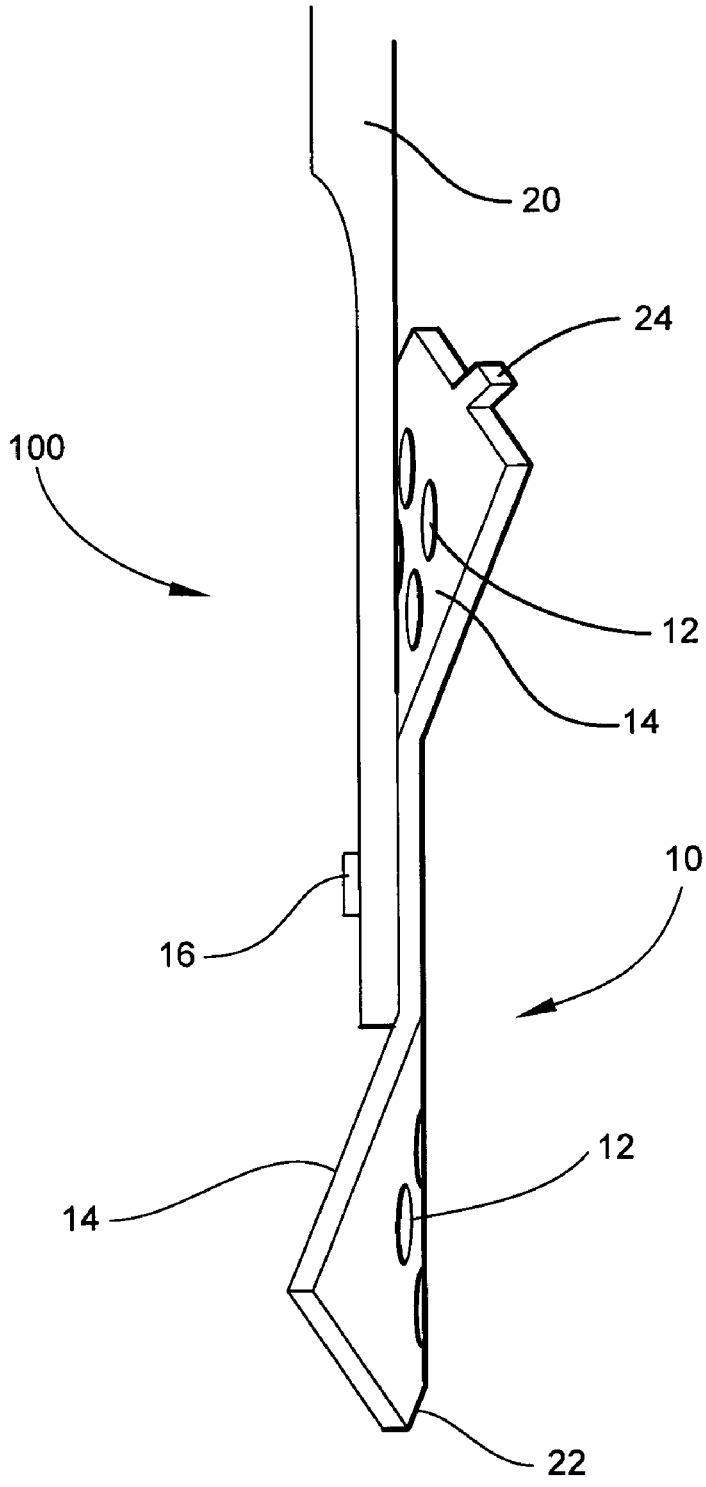
FIG. 2B is a side view of the inventive painting implement in a second position.

FIGS. 2A and 2B illustrate the painting implement 100 in a second, substantially linear or parallel position wherein the paddle member 10 is positioned substantially parallel to, but with an offset of an acute angle with respect to the rod shaft 20 (described further below). In this second position, the implement 100 functions as an element for mixing/stirring in a smaller container (typically 1 gallon or 1 quart), mixing/stirring thinner fluids in order to prevent excessive splashing which could be caused by using the first position, or for supporting a paint roller for cleaning (described below).

FIGS. 4A & 4B show the implement 100 in use stirring paint 42 within a paint container 40. The arrows indicate movement currents of the paint 42 as it is being mixed. The perforations 12 within paddle member 10, in conjunction with the deflections 14 of paddle member 10, both play a major part in further assisting with the mixing (i.e., stirring motion) of the paint 42 when the paddle is in motion. Additionally, paint may be stirred in a larger, unopened container by inserting the paddle member 10 through the bung hole (not shown) of the lid (not shown) of the container with the paddle in the second, linear position. Centrifugal force may cause the paddle member 10 to open to the lateral position of FIG. 1A, or it may be used in the linear position.

Figure 5:
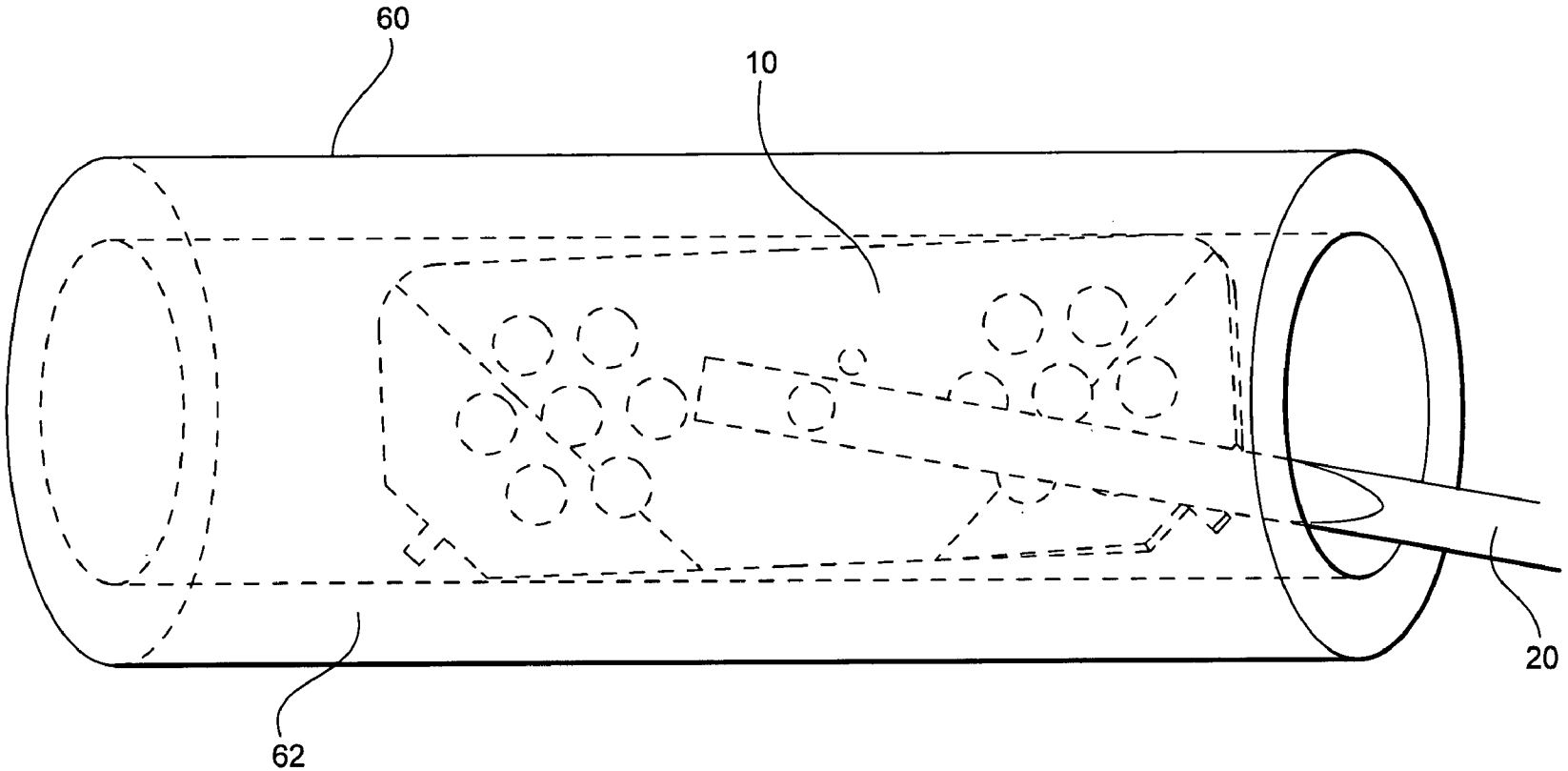
FIG. 5 is an environmental perspective view of the painting implement of the present invention with a paint roller installed thereon.

Additionally, this second position may also be employed to assist with the cleaning of a paint roller 60, as shown at FIGS. 5 and 6. For the purpose of cleaning the roller 60, the paddle member 10 is inserted into the interior wall 62 of paint roller 60, in the linear configuration of FIGS. 2A and 2B, with the slight deviation from the rod shaft 20 allowing the paddle member 10 and the rod shaft 20 to engage the interior of the paint roller 60 to frictionally hold the paint roller 60 on the implement 100. As shown in FIG. 6, paint roller 60 may be inserted in a container 70 containing a cleaning solution 72. A hand drill 50 coupled to the paddle member 10 (by way of a distal end 20*d* of shaft 20) spins the roller 60, as indicated by arrow 75. The centrifugal forces produced by the offset shape of the paddle member 10 during the spinning aids in the removal of paint embedded within the fibers of roller 60 by producing a whipping action. This oscillation greatly enhances the cleaning process.

In addition to being cleaned in a container, the paint roller 60 may be sprayed from a nozzle head (not shown) as the hand drill 50 rotates the element 100 and paint roller 60.

The present invention is susceptible to variations and modifications which may be introduced thereto without departing from the inventive concept. For example, paddle member 10 may be removable from rod shaft 20, rather than having a rivet at pivot fastener 16. Instead, paddle member 10 could be retained by friction in the two operative positions, if desired. Additionally, the size of the paddle member 10 may vary so that it may be usable with paint rollers 60 of different dimensions. The paddle member 10 may have edges formed in a beveled manner, as well, to facilitate other uses of the paddle 10, such as scraping the interior of paint cans, etc. Furthermore, while a rigid paddle member 10 is preferred, a flexible paddle member 10 may also be utilized, allowing for more flexibility as a spatula for removing paint from a can.

Figure 7:
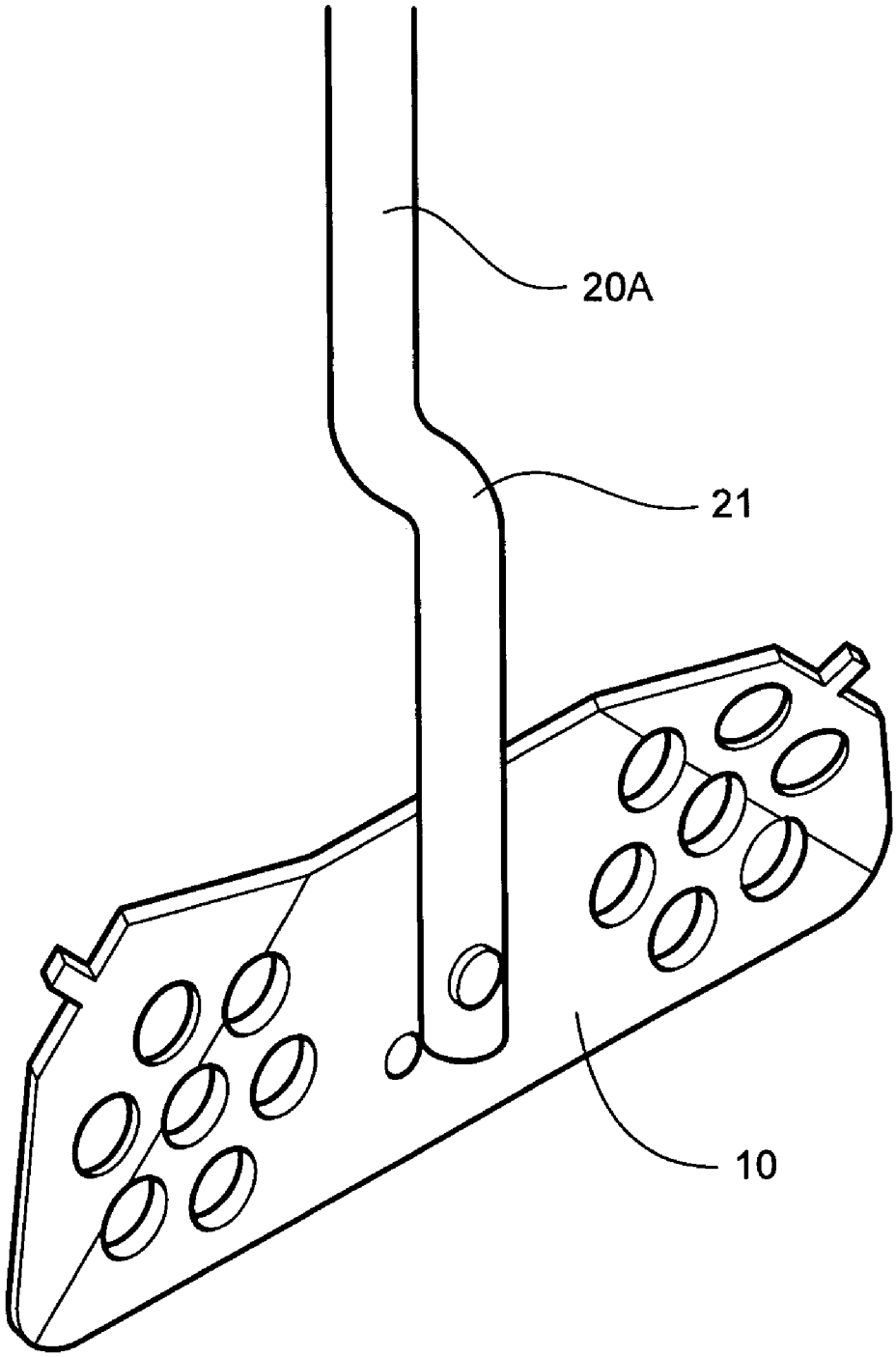
FIG. 7 is a front view of a third embodiment of the painting implement of the present invention having a shaft with an axially offset proximal portion.

In alternative embodiments, the rod shaft 20A may have an offset 21 along its length (FIG. 7), proximate the proximal end 20*p*. The paddle member 10 is mounted within the offset 21, which aids in maintaining a center of balance for the implement 100 which lies more along the axis of the shaft 20A, thereby reducing any wobble which would be caused by the blade 10 being attached to one side of the shaft.

Figure 8:
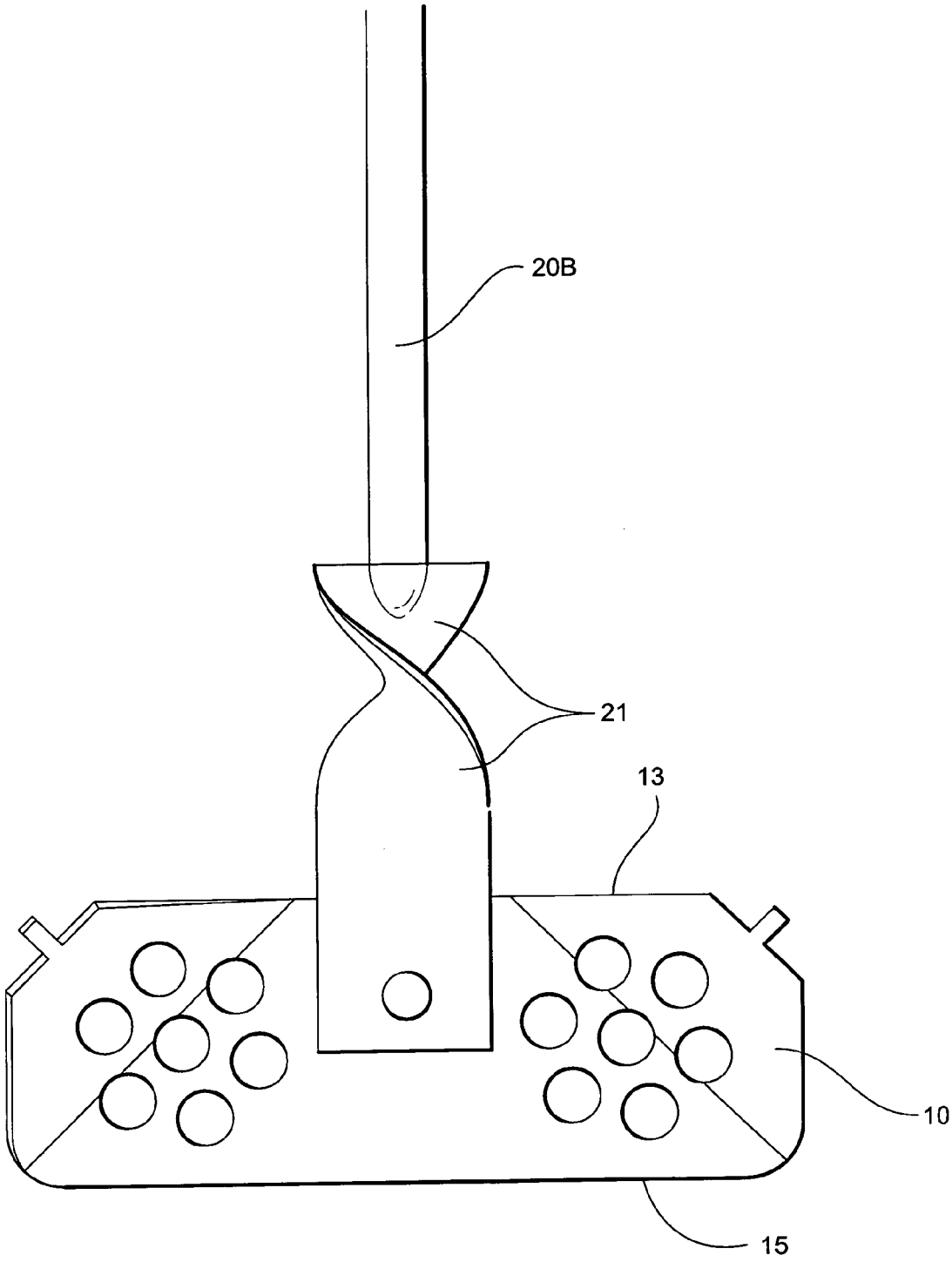
FIG. 8 is an environmental perspective view of a fourth embodiment of the painting implement wherein a proximal portion of the shaft has a broad shaft paddle.

At FIG. 8, the rod shaft 20B may have a broad shaft paddle 21 formed therein. The shaft paddle 21 may either have a twist, as shown, or be flat (not shown). The shaft paddle 21 increases the agitation of the paint 42 beyond that of the paddle member 10. Additionally, the upper 13 and lower 15 edges of the paddle member 10 may be more flexible than the body of the paddle member 10, thereby providing additional gripping of the interior of a paint roller 60 when it is inserted therein.

It would be evident to one of ordinary skill in the art that the implement 100 of the present invention may be formed in a variety of ways, including extrusions and injection molding, of a variety of materials, and metals and polymers, and in a variety of material weights, from light for paints, to heavy for thicker fluids, such as sheet rock compound.

It is to be understood that the present invention is not limited to the embodiments described above, but encompasses any and all embodiments within the scope of the following claims.

What is claimed is:

1. An implement for alternately stirring a fluid substance in a container and holding implements for cleaning, after use, comprising:

stirring means for alternately agitating and mixing a fluid substance within a container and holding implements for purposes of cleaning, after use, a shaft having a proximal end and a distal end, said distal end comprising means for removable attachment to an external, drive means, attachment means for pivotably attaching said stirring means to said proximal end of said shaft, and stop means for limiting the degree of rotation of said stirring means about said proximal end of said shaft such that the stirring means cannot rotate to a point where it is parallel to said shaft;

wherein said stirring means comprises a paddle member having a length, a height and a thickness, two upper corners, and two lower corners, wherein each of the upper corners of said paddle member are deflected from the plane of the rest of the paddle member, each of the two upper corners being deflected respectively toward opposite sides of said paddle member from each other such that, as said paddle member rotates around said shaft, the deflected corners precede the face of said paddle member, thereby increasing agitation in the fluid substance being stirred.

2. An implement for alternately stirring a fluid substance in a container and holding implements for cleaning, after use, as defined in claim 1, wherein said paddle member has at least one aperture formed through the thickness thereof, said aperture aiding in the stirring of a fluid substance by enabling a fluid substance being stirred to flow therethrough.

3. An implement for alternately stirring a fluid substance in a container and holding implements for cleaning, after use, as defined in claim 2, wherein said at least one aperture comprises a plurality of apertures.

4. An implement for alternately stirring a fluid substance in a container and holding implements for cleaning, after use, as defined in claim 3, wherein said plurality of apertures are formed at differing angles from one another as they pass through said paddle member.

5. An implement for alternately stirring a fluid substance in a container and holding implements for cleaning, after use, as defined in claim 3, wherein a lower edge of said paddle member is configured to form a spatula to aid in the removal of said fluid from said container.

6. An implement for alternately stirring a fluid substance in a container and holding implements for cleaning, after use, as defined in claim 1, wherein said two lower corners of said paddle member are rounded.

7. An implement for alternately stirring a fluid substance in a container and holding implements for cleaning, after use, as defined in claim 1, wherein each of said deflections begins on a line extending from one of said lower corners to a point between an adjacent upper corner and a point between a midpoint between said two upper corners.

8. An implement for alternately stirring a fluid substance in a container and holding implements for cleaning, after use, as defined in claim 1, wherein an upper edge and a lower edge of said paddle member are more flexible than the rest of the paddle member, thereby aiding in grasping the interior of a paint roller when said paint roller is installed on said implement for cleaning.

9. An implement for alternately stirring a fluid substance in a container and holding implements for cleaning, after use, as defined in claim 1, wherein said shaft is substantially solid throughout its length, said shaft being flattened along a portion of its proximal end, said flattened portion having two flattened exterior faces oriented away from each other, located on opposite sides of said proximal end, one of said flattened faces providing a flat interface between said shaft and a face of said paddle member.

10. An implement for alternately stirring a fluid substance in a container and holding implements for cleaning, after use, as defined in claim 1, wherein said shaft has at least one bend therein which causes a proximal end of said shaft is to be axially offset from the rest of said shaft, said paddle member being attached along said offset proximal portion, thereby allowing said implement to maintain a center of gravity along said axis, thereby reducing wobble as said implement is rotated at high speeds.

11. An implement for alternately stirring a fluid substance in a container and holding implements for cleaning, after use, as defined in claim 1, wherein said shaft has a flattened shaft paddle formed therein proximate said proximal end, said shaft paddle being substantially wider than the portion of the shaft distal thereto, a proximal end of said flattened shaft paddle supporting said paddle member, and said shaft paddle supplementing the agitation action of said paddle member.

12. An implement for alternately stirring a fluid substance in a container and holding implements for cleaning, after use, as defined in claim 1, wherein said attachment means comprises one from the group consisting of a rivet and a nut and bolt, said rivet or nut and bolt passing through said paddle member at a point proximate a midpoint thereof and through said shaft at a point proximate said proximal end thereof.

13. An implement for alternately stirring a fluid substance in a container and holding implements for cleaning, after use, as defined in claim 1, wherein said stop means comprises a nub extending outwardly from a face of said paddle member in such a position that:

as said shaft rotates around said attachment means in a first direction, a point on said shaft between said attachment means and said proximal end strikes said stopping means, thereby limiting said rotation such that said paddle member lies substantially normal to said shaft, in a first, lateral position, said first, lateral position being suitable for stirring a liquid in a wide container, and as said shaft rotates around said attachment means in a second direction, opposite to said first direction, a point on said shaft between said attachment means and said distal end strikes said stopping means, thereby limiting said rotation such that said paddle member lies substantially, but not precisely, parallel said shaft, in a second, linear position, said second position being suitable for stirring a liquid in a narrow container and for fitting said paddle member snugly into the interior of a paint roller such that an edge of said interior of said paint roller engages said shaft to stabilize a connection between said paint roller and said implement, such that said paint roller may be rotated for cleaning.

14. An implement for alternately stirring a fluid substance in a container and holding implements for cleaning, after use, as defined in claim 1, wherein one of said upper corners is cut off at an angle to said height and length, presenting a substantially straight edge across said corner, and extending from said substantially straight edge is a substantially rectilinear groove cleaning projection configured and dimensioned to fit into the lip groove of a paint can for cleaning accumulated paint from said lip groove.

15. An implement for alternately stirring a fluid substance in a container and holding implements for cleaning, after use, as defined in claim 1, wherein one of said upper corners is cut off at an angle, presenting a substantially straight edge across said corner, and extending from said substantially straight edge is a substantially rectilinear can opener projection configured and dimensioned to fit under the edge of a paint can lid for removing said paint can lid by prying upwardly with said projection, said can opener projection being at a slight angle from the plane of said deflection to facilitate ease of prying.

16. An implement for alternately stirring a fluid substance in a container and holding implements for cleaning, after use, comprising:

stirring means for alternately agitating and mixing a fluid substance within a container and holding implements for purposes of cleaning, after use, a shall having a proximal end and a distal end, said distal end comprising means for removable attachment to an external, drive means, attachment means for pivotably attaching said stirring means to said proximal end of said shaft, and stop means for limiting the degree of rotation of said stirring means about said proximal end of said shaft such that the stirring means cannot rotate to a point where it is parallel to said shaft;

wherein said stirring means comprises a paddle member having a length, a height, a thickness, and a front surface and a back surface oriented substantially parallel to one another, said paddle member having a plurality of apertures formed through the thickness thereof, with each aperture having a longitudinal axis extending the length of the aperture through said thickness of said paddle member, said apertures aiding in the stirring of a fluid substance by enabling a fluid substance being stirred to flow therethrough;

and wherein the angle which the longitudinal axis of at least a first one of said plurality of apertures forms with the front and back surfaces of said paddle member differs from the angle which the longitudinal axis of at least another one of said plurality of apertures forms with the front and back surfaces of said paddle member.

17. An implement for alternately stirring a fluid substance in a container and holding implements for cleaning, after use, comprising:

stirring means for alternately agitating and mixing a fluid substance within a container and holding implements for purposes of cleaning, after use, a shaft having a proximal end and a distal end, said distal end comprising means for removable attachment to an external, drive means, attachment means for pivotably attaching said stirring means to said proximal end of said shaft, and stop means for limiting the degree of rotation of said stirring means about said proximal end of said shaft such that the stirring means cannot rotate to a point where it is parallel to said shaft;

wherein said stirring means comprises a paddle member having a length, a height and a thickness, two upper corners, and two lower corners, wherein one of said corners is cut off at an angle to said height and length, presenting a substantially straight edge across said corner, and extending from said substantially straight edge is a substantially rectilinear groove cleaning projection configured and dimensioned to fit into the lip groove of a paint can for cleaning accumulated paint from said lip groove.

18. An implement for alternately stirring a fluid substance in a container and holding implements for cleaning, after use, comprising:

stirring means for alternately agitating and mixing a fluid substance within a container and holding implements for purposes of cleaning, after use, a shaft having a proximal end and a distal end, said distal end comprising means for removable attachment to an external, drive means, attachment means for pivotably attaching said stirring means to said proximal end of said shaft, and stop means for limiting the degree of rotation of said stirring means about said proximal end of said shaft such that the stirring means cannot rotate to a point where it is parallel to said shaft;

wherein said stirring means comprises a paddle member having a length, a height and a thickness, two upper corners, and two lower corners, wherein one of said corners is cut off at an angle to said height and length, presenting a substantially straight edge across said corner, and extending from said substantially straight edge is a substantially rectilinear can opener projection configured and dimensioned to fit under the edge of a paint can lid and having the requisite strength for removing said paint can lid by prying upwardly with said projection, said can opener projection being at a slight angle to the portion of the paddle member from which it projects to facilitate ease of prying.

* * * * *